US010822804B2

(12) United States Patent
Dubau

(10) Patent No.: US 10,822,804 B2
(45) Date of Patent: Nov. 3, 2020

(54) RETRACTABLE AWNING

(71) Applicant: Gordon Dubau, Felm (DE)

(72) Inventor: Gordon Dubau, Felm (DE)

( * ) Notice: Subject to any disclaimer, the term of this patent is extended or adjusted under 35 U.S.C. 154(b) by 0 days.

(21) Appl. No.: 15/631,172

(22) Filed: Jun. 23, 2017

(65) Prior Publication Data

US 2017/0370107 A1 Dec. 28, 2017

(30) Foreign Application Priority Data

Jun. 24, 2016 (DE) ..... 10 2016 111 664

(51) Int. Cl.
*E04F 10/06* (2006.01)
*E04H 15/32* (2006.01)
*E04H 15/58* (2006.01)

(52) U.S. Cl.
CPC ..... *E04F 10/0655* (2013.01); *E04F 10/0648* (2013.01); *E04F 10/0681* (2013.01); *E04H 15/322* (2013.01); *E04H 15/58* (2013.01)

(58) Field of Classification Search
CPC .. E04F 10/0655; E04F 10/0681; E04H 15/58; E06B 2009/425; E06B 9/42
USPC ..... 160/265, 66, 68, 27, 28; 135/117
See application file for complete search history.

(56) References Cited

U.S. PATENT DOCUMENTS 1,521,155 A * 12/1924 Isaacs ..... E06B 9/78 160/265
5,159,967 A * 11/1992 Ashley ..... E06B 9/62 160/189
5,632,317 A * 5/1997 Krupke ..... E06B 9/13 160/264
2007/0181269 A1* 8/2007 Spiess ..... B66B 13/08 160/265
2010/0252212 A1* 10/2010 Daniel ..... A63C 19/12 160/368.1

FOREIGN PATENT DOCUMENTS

| | | |
|---|---|---|
| DE | 202008009014 | 12/2008 |
| DE | 20 2010 011307 | 11/2010 |
| DE | 102011112523 | 4/2012 |
| DE | 20 2011 109768 | 5/2012 |
| DE | 102010055681 | 6/2012 |
| DE | 102013104777 | 11/2014 |

(Continued)

OTHER PUBLICATIONS

Kromer, C., "Spring Balancers & Zero Gravity Balancers." Carl Stahl Kromer. www.federzug.com.

(Continued)

*Primary Examiner* — Katherine W Mitchell
*Assistant Examiner* — Jeremy C Ramsey
(74) *Attorney, Agent, or Firm* — Diederiks & Whitelaw, PLC

(57) ABSTRACT

Retractable awning with a cloth shaft, a cloth attached by one end thereof to the cloth shaft and winding onto and unwinding from the cloth shaft, at least one pulling cable connected by its one end to the free end of the cloth, at least one mast, and a cable winch disposed on the mast and featuring a cable drum, wherein the cable winch is connected to the other end of the pulling cable and is designed to retract and to unwind the pulling cable, characterized in that the cable winch is designed as a load balancer featuring a conical cable drum.

7 Claims, 4 Drawing Sheets

(56) References Cited

FOREIGN PATENT DOCUMENTS

| | | |
|---|---|---|
| EP | 2216460 | 8/2010 |
| FR | 2923853 | 5/2009 |
| WO | 2007/113518 | 10/2007 |
| WO | 2011/101876 | 8/2011 |
| WO | 2015/022324 | 2/2015 |
| WO | 2016/023110 | 2/2016 |

OTHER PUBLICATIONS

Machine-Generated Translation of DE102013104777 Description. PDF. Espacenet, Nov. 2014.

* cited by examiner

RETRACTABLE AWNING

CROSS-REFERENCE TO RELATED APPLICATION

This application claims priority from and the benefit of German patent application No. 10 2016 111 664.5, filed on Jun. 24, 2016 and incorporated herein by reference.

BACKGROUND OF THE INVENTION

The invention relates to a retractable awning with a cloth shaft, a cloth attached by one end thereof to the cloth shaft and winding onto and unwinding from the cloth shaft, at least one pulling cable connected by its one end to the free end of the cloth, at least one mast, and a cable winch disposed on the mast and featuring a cable drum, wherein the cable winch is connected to the other end of the pulling cable and is designed to retract and to unwind the pulling cable.

A retractable awning designed in this manner is known, for example, from WO 2015/022 324 A1.

The retractable awning known from WO 2015/022 324 A1 features in particular a pulling cable which is tensioned by a tensioning device with a preset tension value, wherein the tensioning device contains a cable reserve such that when the tensile stress on the pulling cable exceeds the set tension, this cable reserve is reduced in order to lengthen the effective length of the pulling cable, and when the tensile stress on the pulling cable is less than the set tension, this cable reserve is increased in order to shorten the effective length of the pulling cable. Specifically, WO 2015/022 324 A1 makes use of a tensile force comparator acting on a drive motor controlling the cable tension.

In comparison to DE 10 2013 104 777 A1, the advantage of the first-named prior art is that of a more compact design in which the voluminous weights are avoided and thus the design size of the tensioning unit can be reduced.

Nonetheless, the awning assemblies known from the prior art are quite complicated and high-maintenance due to their design and operation. Moreover, a permanent operation of a drive motor is disruptive and also too slow to counteract any suddenly occurring wind gusts.

Therefore the invention is to a retractable awning with a simple and sturdy design which can also keep the cable tension constant under suddenly occurring wind loads.

SUMMARY OF THE INVENTION

Thus the invention relates to a retractable awning with a cloth shaft, a cloth attached by one end thereof to the cloth shaft and winding onto and unwinding from the cloth shaft, at least one pulling cable connected by its one end to the free end of the cloth, at least one mast, and a cable winch disposed on the mast and featuring a cable drum, wherein the cable winch is connected to the other end of the pulling cable and is designed to retract and to unwind the pulling cable, wherein the cable winch features a spring exerting a torque onto the cable drum to compensate any loads applied to the pulling cable and/or to the sail cloth which differ from the spring tension.

The spring (also called the support spring) is attached on one side to the shaft of the cable winch (also designated as the spring snap) and on the other side to the cable drum and is pre-tensioned such that the pulling cable in operation exerts an essentially consistent tension on the cloth across the entire pulling region. Thus the spring acts on the drum and in turn, the drum acts on the cable, which is thus under tensile stress. Thus the cable exerts a tensile stress on the sail cloth, which can slacken under wind load—due to the spring—and thus protects the sail cloth etc. against damage.

According to the invention, the cable winch is designed as a load balancer featuring a conical cable drum. The design of the cable drum with a conical shape ensures a consistent spring tension across the pulling region.

Due to the pre-tensioning of the spring of the balancer, which is generally used as a weight compensator, an initial torque and a retraction force will operate. If the pulling cable is extended, then the spring tension and thus also the torque will increase. Thus the increase in torque and the resulting increase in restoring force are compensated by the variable load lever designed as conical cable drum.

The advantage of this embodiment of the subject matter of the invention with a balancer is that the balancer causes a nearly consistent restoring force across the entire cable extractor. Thus, the forces acting on the cloth shaft and the wall masonry to which the cloth shaft is usually secured are minimized, so that in particular large-area, shaded awnings can be created.

To drive the cable winch, in particular an electric motor is provided to act on the shaft of the cable winch.

The retractable awning can be designed in a particularly advantageous manner by providing a diverter unit arranged on the mast, disposed between the cable winch and the cloth for diverting the pulling cable from a vertical plane into a horizontal plane. In this case, the cable winch can be displaced into the interior of the mast which is designed preferably as a hollow element, so that a compact, esthetically smooth structure shielded against external weather factors can be attained.

In particular, the vertical position of the diverter unit on the mast is adjustable, and in particular it is disposed so that the slope of the cloth, e.g. for run-off of rain water, can be specifically adjusted in a continuous manner.

To ensure a consistent transfer of force from the pulling cable to the cloth, the end of the pulling cable connected to the free end of the cloth features a diverter roller, so that transverse forces appearing at the connection between pulling cable and cloth can be deflected so as not to stress the fabric.

In particular, according to an additional, preferred embodiment, the free end of the cloth features a tension cable connected by both ends to the cloth and is guided in the diverter roller of the pulling cable.

To reinforce the cloth, it is additionally possible to form the free end of the cloth by a terminal strip connected to the free end of the cloth.

Finally, it is also an advantage that the sides of the cloth have a concave shape and are designed as reinforced with textile or plastic strips, so that the cloth displays a certain inherent tensioning across its width and length which also promotes the correct winding and unwinding of the cloth on the cloth shaft.

The invention is suitable especially for textile sunshade systems, which are exposed in particular to suddenly occurring, powerful winds. In the case of awnings, solar sails or other structures, the textile cloths are stressed by the wind, the cloths move and guide the occurring forces to the points of attachment. Depending on the wind strength, damage to the points of attachment, such as the masonry wall, can occur.

This is prevented or at least greatly alleviated by the present invention.

If the cloth is placed fully upon the winding shaft, then the spring tension is at the maximum, so that a smooth dispensing of the cloth is assured.

If the cloth is half rolled up on the winding shaft and half extended, so that a partial region of the area to be shaded is actually shaded, then the spring tension holds the cloth under tension.

Even if the cloth is shading the entire area to be shaded and is thus fully unrolled from the cloth shaft, the cloth is still held under tension with the same tensile force as in the other states.

Due to the consistent tensile force of the springs in every state, occurring winds are absorbed directly by the springs so that powerful wind forces are no longer directed onto the masonry wall. Rather, the springs slacken enough so that as soon as the wind is caught in the fabric, the forces are cancelled out and are self-eliminated. This ensures that the points of attachment to the masonry no longer need absorb any forces and thus will no longer cause any damage. Any destruction of the fabric or even of the assembly is thus also virtually eliminated since the springs could again dispense the entire, wound-up cable.

However, since a nearly constant spring tension is required for permanent tensioning of the cloth across the dispensing region of the awning, in the event of a cable break owing to the pre-tensioning of the cable, there is a potential for injury to persons and/or physical property.

According to the invention, therefore, a safety brake acting as a centrifugal brake is proposed, which stops the rotation of the cable winch caused by the pretension in case of a cable break. The retractable awning 10 also features vertically adjustable deflectors 31, each deflector 31 arranged on a mast 50 and deflecting the pulling cable 40 from a vertical plane onto a horizontal plane. Thus an abrupt and uncontrolled retraction of the cable is prevented and persons and property are shielded against damage caused by a recoiling cable.

BRIEF DESCRIPTION OF THE FIGURES

The invention will be explained in greater detail below based on one exemplary embodiment which is depicted in the included drawings. We have.

DESCRIPTION OF THE PREFERRED EMBODIMENTS

Figure 1:
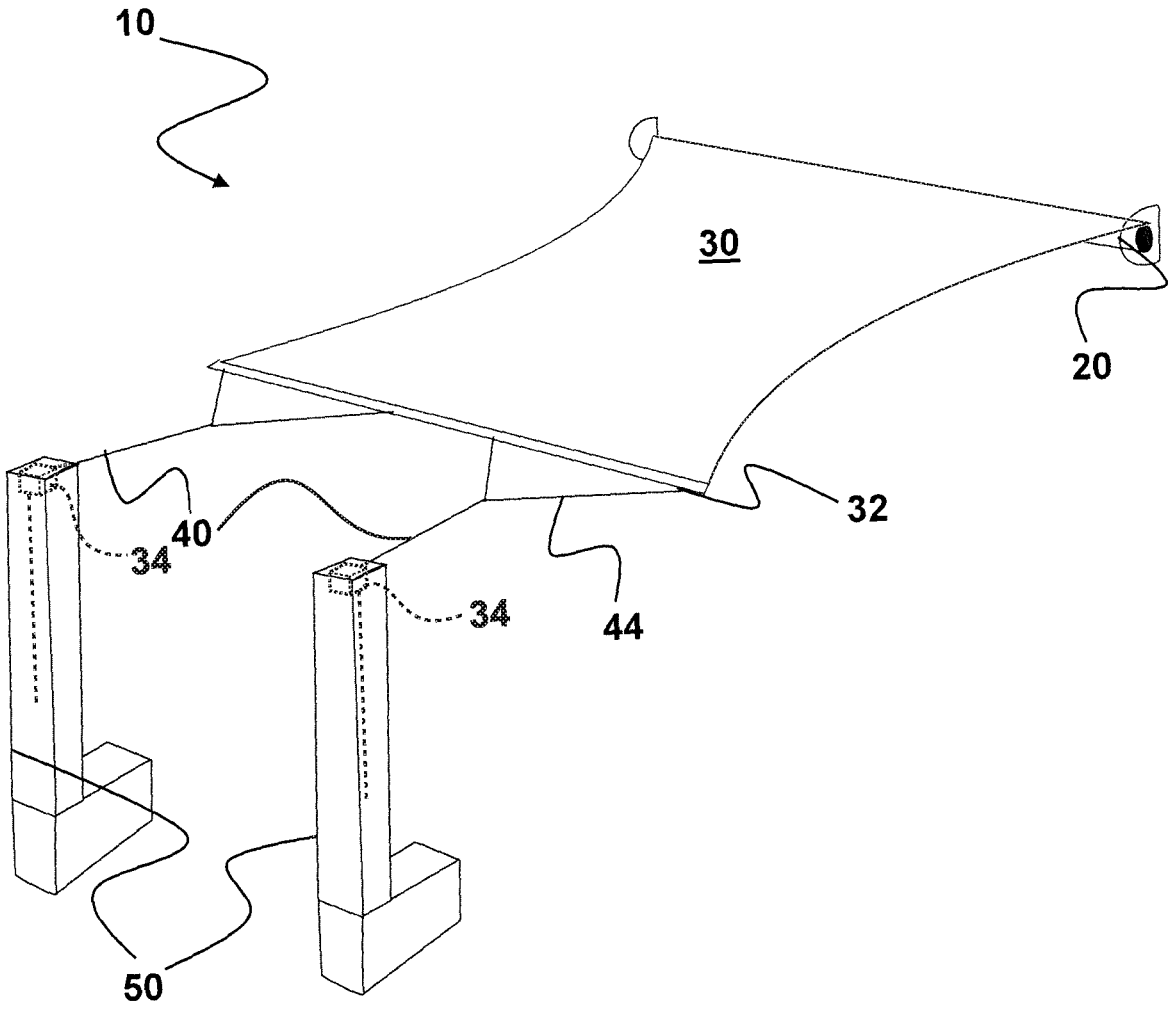
FIG. 1 A perspective view of a schematic design of a particularly preferred embodiment of the invention.

FIG. 1 provides a perspective view of a schematic design of one particularly preferred exemplary embodiment of the invention.

Accordingly, the retractable awning 10 features a cloth shaft, a cloth 30 attached by one end thereof to the cloth shaft 20 and winding onto and unwinding from the cloth shaft 20, and two pulling cables 40 connected by their one end to the free end of the cloth. The retractable awning 10 also features vertically adjustable deflectors 31, each deflector 31 arranged on a mast 50 and deflecting the pulling cable 40 from a vertical plane onto a horizontal plane. To reinforce the cloth 30, it is additionally possible to form the free end of the cloth 30 by a terminal strip 32 connected to the free end of the cloth 30.

Each pulling cable 40 is connected by its other end to a mast 50, which each accommodates a cable winch disposed on the mast 50 and featuring a cable drum 62, wherein the cable winch features a spring exerting a torque upon the cable drum to compensate for loads on the pulling cable and/or on the sail cloth which differ from the spring tension.

Figure 2:
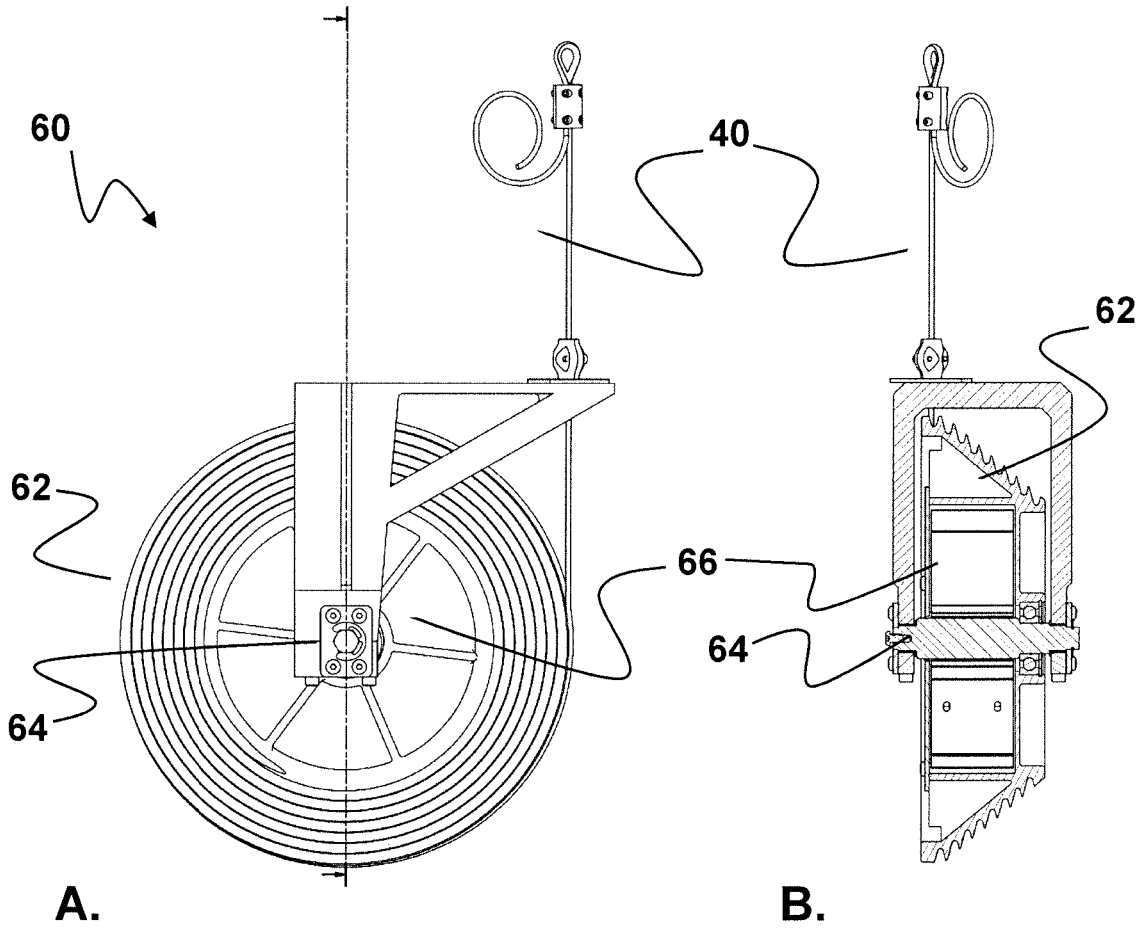
FIG. 2 A frontal (A) and a side (B) view of a cable winch designed as balancer.

In particular, the cable winch is designed as the balancer depicted in FIG. 2.

The cable winch 60 designed as balancer, which is disposed concealed in one of the masts depicted in FIG. 1, for example, features a conical cable drum 62 accommodating the pulling cable 40. The cable drum 62 can be driven by a motor-driven shaft 64, and a spring 66 is provided whose one end is connected to the shaft 64 and whose other end is connected to the cable drum 62, so that a torque is applied to the cable drum 62 and the pulling cable 40 is pre-tensioned.

Figure 3:
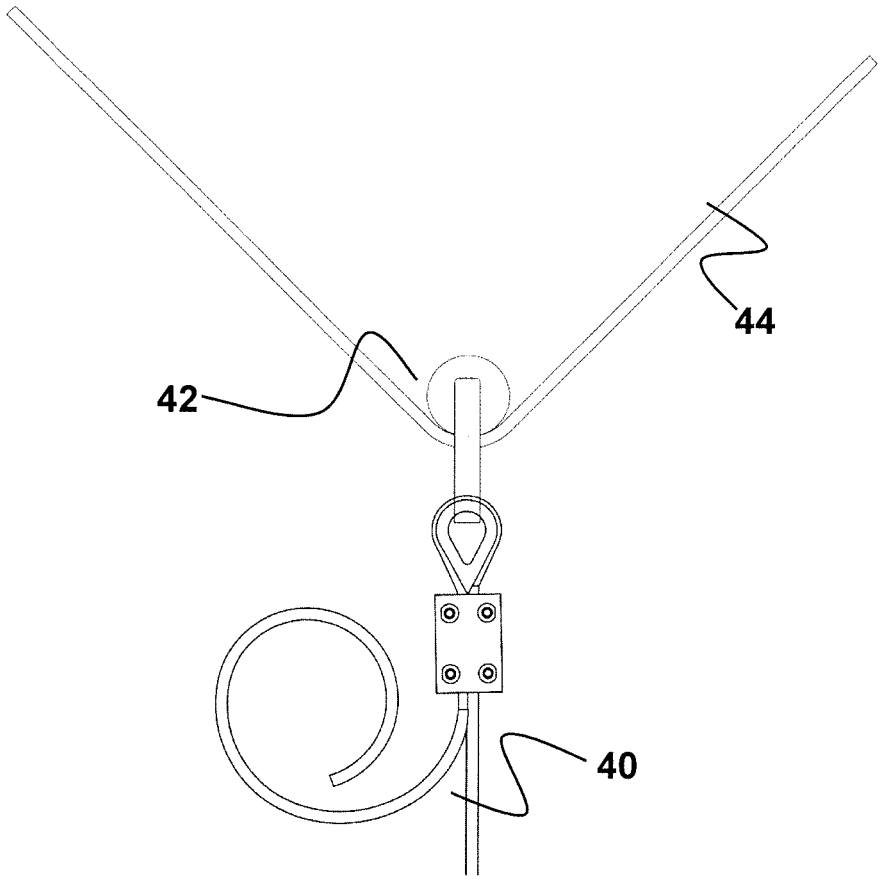
FIG. 3 A perspective detail of the embodiment depicted in FIG. 1 shown in the region of the connection of pulling cable and tension cable.

Furthermore, FIG. 3 presents a perspective detail of the exemplary embodiment depicted in FIG. 1, showing the region of the connection of pulling cable 40 and tension cable 44. In order to ensure a consistent transfer of force in the horizontal plane from pulling cable 40 onto the cloth 30, the end of the pulling cable 40 connected to the free end of the cloth 30 features a diverter roller 42. Due to this feature, transverse forces occurring between pulling cable 40 and cloth 30, which are caused e.g. by winds attacking underneath the cloth, are deflected in a manner so as not to stress the fabric.

Figure 4:
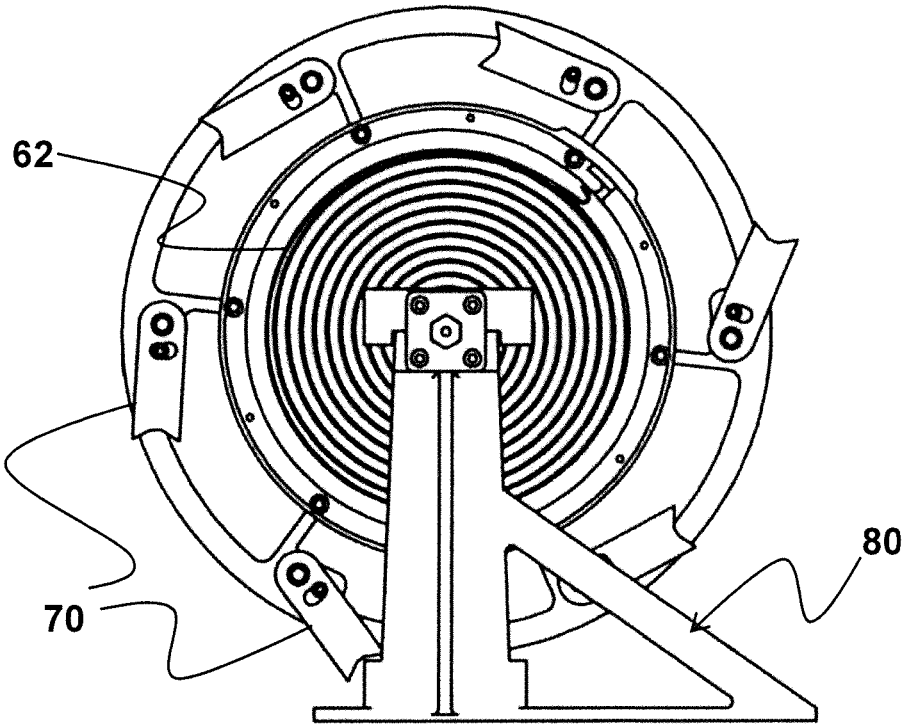
FIG. 4 A side view of one particularly preferred embodiment of a cable winch with a safety brake.

Finally, FIG. 4 shows one particularly preferred design of the cable winch with a safety brake.

As depicted above, for a permanent cloth tensioning, an approximately constant spring tension across the extension region of the awning is necessary. It makes no difference here whether the awning is extended or retracted—there is always a (pre-)tensioning of the cable.

But if the cable were to break, then there is a potential for injury to persons and/or property due to the pre-tensioning of the cable. The situation is quite hazardous when the spring tension is at the maximum and the cable breaks near the cloth. The cable—usually made of steel—can thus readily spin around itself until the spring has relaxed.

Therefore preferably a safety brake acting as a centrifugal force brake is proposed.

As FIG. 4 shows, safety elements 70 are provided on the spring drum 62 which shear off due to the force of gravity and at an increased speed of rotation, such that they jam against a solid abutment 80 specifically provided for this purpose. This abutment can be, for example, the base supporting the rotating drum.

The standard speed of rotation is normally specified by the motor of the system. At a standard speed of rotation the safety elements 70 are in the stopped position and do not engage with the abutment 80 during the rotation. Only if the cable breaks will the spring 66 not have any opposing pull and then tends to relax as quickly as possible. Thus an increased speed of rotation of the spring drum 62 occurs and the centrifugal brake will operate.

The invention claimed is:

1. A retractable awning comprising:

a cloth shaft, a cloth which is connected by one end to the cloth shaft and can be wound onto and unwound from the cloth shaft, a tension cable which is connected by both ends thereof to the cloth at a free end of the cloth, a diverter roller, wherein the tension cable is guided in the diverter roller a pulling cable which is connected by one end to the diverter roller, a mast, and a cable winch which is arranged on the mast, comprises a cable drum and a drive shaft, is connected to another end of the pulling cable and is designed to retract and to unwind the pulling cable, wherein the cable winch is a load balancer including a spring with one end operatively connected to the cable drum and another end operatively connected to the drive shaft, wherein the load balancer is configured to provide a nearly consistent restoring force as the cloth is wound onto and unwound from the cloth shaft, and the cable drum is a conical cable drum.

2. The retractable awning according to claim 1, characterized in that the free end of the cloth is formed by a terminal strip connected to the free end of the cloth.

3. The retractable awning according to claim 1, characterized in that the sides of the cloth have a concave shape.

4. The retractable awning according to claim 1, characterized in that the cable winch comprises a centrifugal brake.

5. The retractable awning according to claim 1, wherein the pulling cable is pre-tensioned.

6. The retractable awning according to claim 1, further comprising a deflector arranged on the mast and deflecting the pulling cable from a vertical plane onto a horizontal plane.

7. The retractable awning according to claim 6, wherein the deflector is vertically adjustable.

* * * * *